United States Patent [19]

Fulton

[11] 4,156,380

[45] May 29, 1979

[54] MUSICAL INSTRUMENTS

[76] Inventor: Truxton K. Fulton, 169 Confederate Ave., Danville, Va. 24541

[21] Appl. No.: 711,355

[22] Filed: Aug. 3, 1976

[51] Int. Cl.[2] ..... G10D 1/00

[52] U.S. Cl. ..... 84/171; 84/320; 84/DIG. 30

[58] Field of Search ..... 84/1.16, DIG. 30, 2–3, 84/7–9, 170–171, 173, 258, 313, 315, 320–321, 454, 455, 10–12, 326

[56] References Cited

U.S. PATENT DOCUMENTS

| | | | |
|---|---|---|---|
| 692,248 | 2/1902 | Davis | 84/9 |
| 1,322,795 | 11/1919 | Kent | 84/3 |
| 1,330,078 | 2/1920 | Kent | 84/11 X |
| 1,558,113 | 10/1925 | Mills | 84/326 |
| 1,570,947 | 1/1926 | Cregier | 84/11 |
| 1,579,827 | 4/1926 | Mills | 84/11 |
| 1,727,127 | 9/1929 | Mills | 84/171 |
| 2,949,806 | 8/1960 | Turman | 84/313 X |
| 3,290,981 | 12/1966 | Thibodeaux | 84/11 X |
| 4,023,462 | 5/1977 | Denov et al. | 84/454 |
| 4,044,239 | 8/1977 | Shimauchi et al. | 84/455 X |

*Primary Examiner*—Lawrence R. Franklin

[57] ABSTRACT

A musical instrument comprising a keyboard and related controls (i.e., foot pedals, stops or equivalent controls), which through electronic circuitry remotely direct the mechanical manipulation of taut strings of guitar gauge, enabling the keyboard musician to create the many sounds characteristic of the electric guitar. Apart from the mechanical apparatus engaged with the strings, this invention relates, to a large extent, to the employment and design of the controlling electronic circuitry.

38 Claims, 29 Drawing Figures

FIG. 10
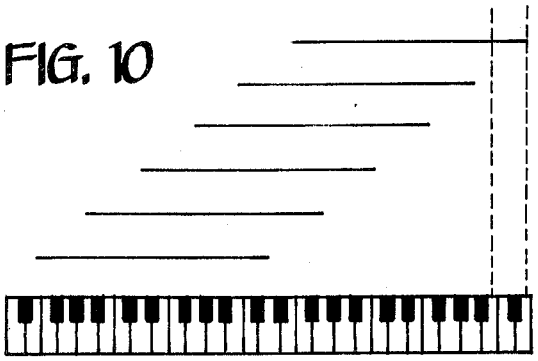
FIG. 10A
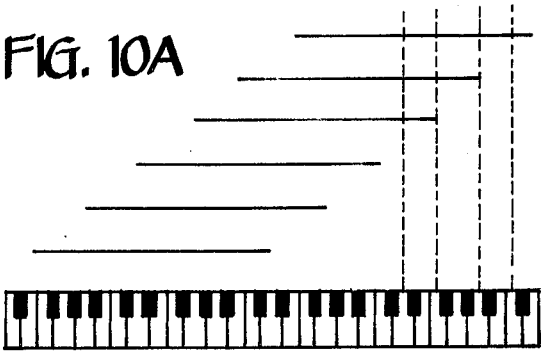
FIG. 11
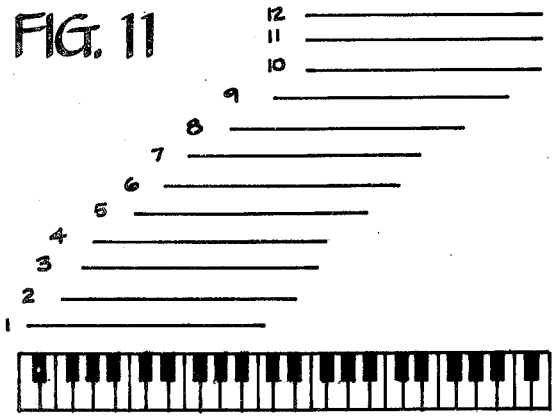
FIG. 12
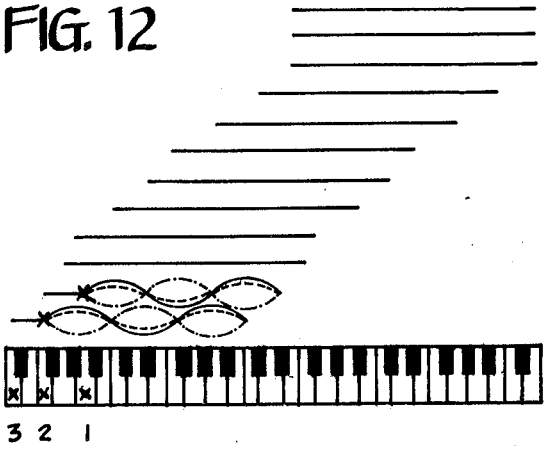
FIG. 13
| NOTE | PRIORITY 1ST | 2ND | 3RD | 4TH |
|---|---|---|---|---|
| $A_1$ | 4 | 3 | 2 | 1 |
| $F_1$ | 2 | 1 | | |
| $D_0$ | 1 | | | |
FIG. 14
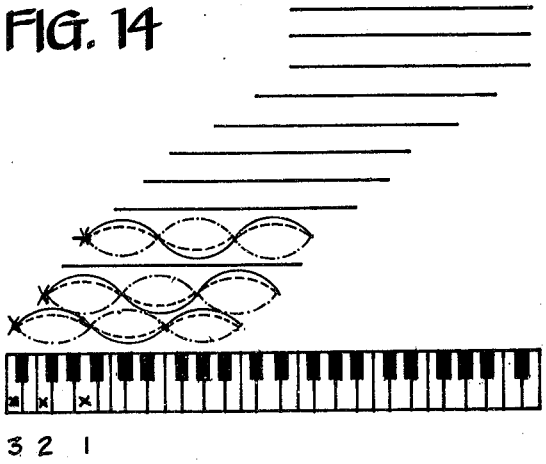

| | |
|---|---|
| PRIORITY SET 1: | 9-8-7-6-5-12-11-10 |
| PRIORITY SET 2: | 12-9-8-11 |
| PRIORITY SET 3: | 5-6-7-8-9-12-11-10 |
| PRIORITY SET 4: | 6-7-5-8-9-12-11 |
| PRIORITY SET 5: | 7-8-9-6-12 |
| PRIORITY SET 6: | 7-6-8-5-9-12-11-10 |

PRIORITY SET 1: 9-12-11-10
PRIORITY SET 2: 12-11

| | | |

MUSICAL INSTRUMENTS

BACKGROUND OF THE INVENTION

This musical instrument relates to the trend to bring the entire spectrum of musical instrument sounds under the control of the organ-type keyboard. This trend perhaps had its start with the development of the pipe organ, which was intended to place flutes, trumpets, etc. under the control of the keyboard. More recently, with the introduction of electronics, there has come an attempt to replicate many instrument sounds by the use of electronic oscillators controllable in pitch, harmonic content, attack, etc. Hence, these electronic keyboard instruments replicate natural instrument sounds synthetically. Thus far it is a matter for debate as to how authentic and pleasing these electronic replications of natural instrument sounds are.

The instrument sound I desire to duplicate is that of the electric guitar. My approach is very direct, much like that of the pipe organ. Here I have designed remotely controlled mechanical apparatus which manipulate actual guitar strings in manners analogous to those employed by a guitarist in the playing of a guitar. Said manipulation is directed by the musician via the instrument's keyboard and related controls (i.e., foot pedals or similar leg-operated controls, stops or equivalent controls). It is, therefore, an object of this invention to produce virtually all of the diverse sounds of the electric guitar. It is a further object that, considering its keyboard nature, it be capable of producing music impossible to produce on the guitar. It is a further object of the preferred embodiment to be completely responsive to virtually any musical composition intended to be played on a keyboard instrument, limited only by its range, forty-nine notes.

The use of mechanical means to pluck and fret strings is somewhat developed in the art. Many such inventions as self-playing banjoes were patented around the turn of the century. U.S. Pat. No. 692,248 makes reference to the possibility of electrically connecting such mechanical means to switches associated with piano keys. However, because electronic technology was not known at this time, the major question which arises from such a reference must be left unresolved. This question relates to the fact that on a piano keyboard, one key is associated with every note of the scale. Yet on a fretboard of such a stringed instrument there may be numerous fret positions associated with any note of the scale. Exactly how, then, are the switches associated with said keys connected with the mechanical means associated with said fret positions?Hereinafter, I will elaborate on this situation and the electronic selector system I employ to cope with it.

Apart from the plucking and fretting of guitar strings there are, of course, other important aspects of guitar playing which contribute to the characteristic guitar sound. These include the guitarist's facility to: (1) slightly "bend," either sharp or flat, the tones produced by the strings (a guitarist does this by altering the tensions of the strings with the fretting fingers, or through the use of a tremolo device); (2) sustain and dampen the sound of the string; (3) vary the intensity of the plucking of the string. The sound produced by an instrument not considering these aspects would resemble more that of a harpsichord than a guitar. In my invention I incorporate means whereby these aspects are represented.

BRIEF EXPLANATION OF THE DRAWINGS

FIGS. 10 and 10A are charts showing chords impossible to sound in an unbroken manner on an instrument identical to the guitar, insofar as the number of strings employed and their tunings.

FIG. 11 is a chart plotting the strings of the preferred embodiment against the keyboard, illustrating their tunings and ranges.

FIG. 12 is a chart showing a three-note chord and the selected strings, where selection is random.

FIG. 13 is a chart showing the preferred priority assigned to each string available to each of the notes in the three-note chord.

FIG. 14 is a chart showing a three note-chord and the selected strings, where selection is made in accordance with the priorities illustrated in FIG. 13.

FIG. 20A is a chart showing the order in which the "error" corrector of FIG. 20 distributes pulses to the individual note selectors.

STATEMENT OF INVENTION

Figure 1:
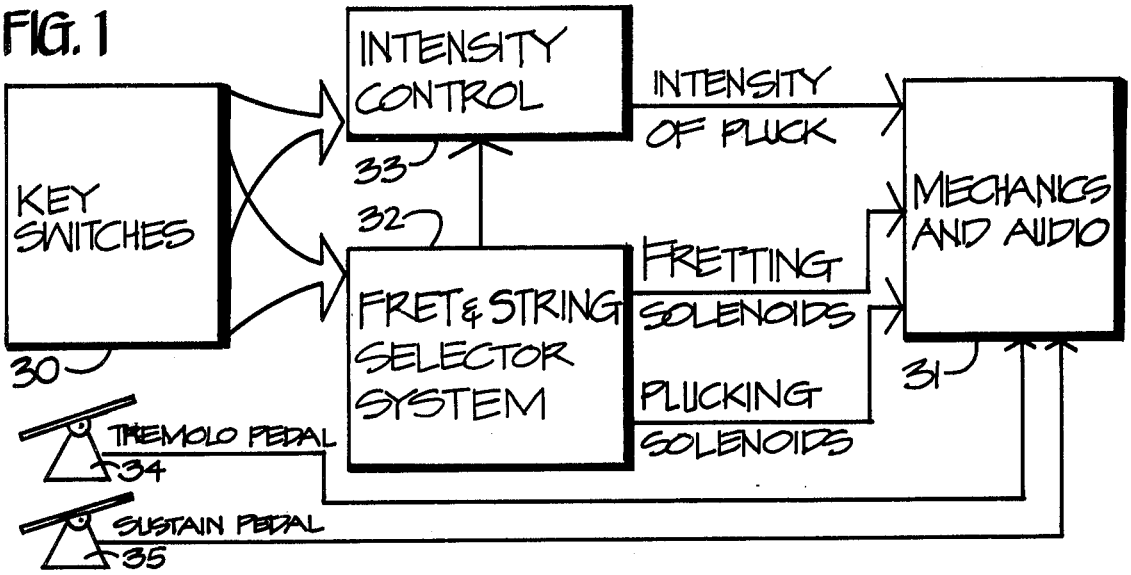
FIG. 1 is an overall schematic diagram of the preferred embodiment.

FIG. 1 illustrates an overall block diagram of the preferred embodiment. The keyswitches (30) direct the actual mechanics (31) via electronic circuitry. The fret and string selector system (32) is the electronic circuitry which relates to the selection of a proper string and fret position on which a desired note is produced. The intensity control (33) relates to controlling the intensity of the pluck as dictated by the speed at which the associated key is depressed. The tremolo pedal (34) enables the keyboard musician to "bend" tones, either sharp or flat. It is the function of the sustain pedal (35) to act much like the sustain pedal of a piano, inhibiting the otherwise automatic dampening of a string after the key is released.

Figure 2:
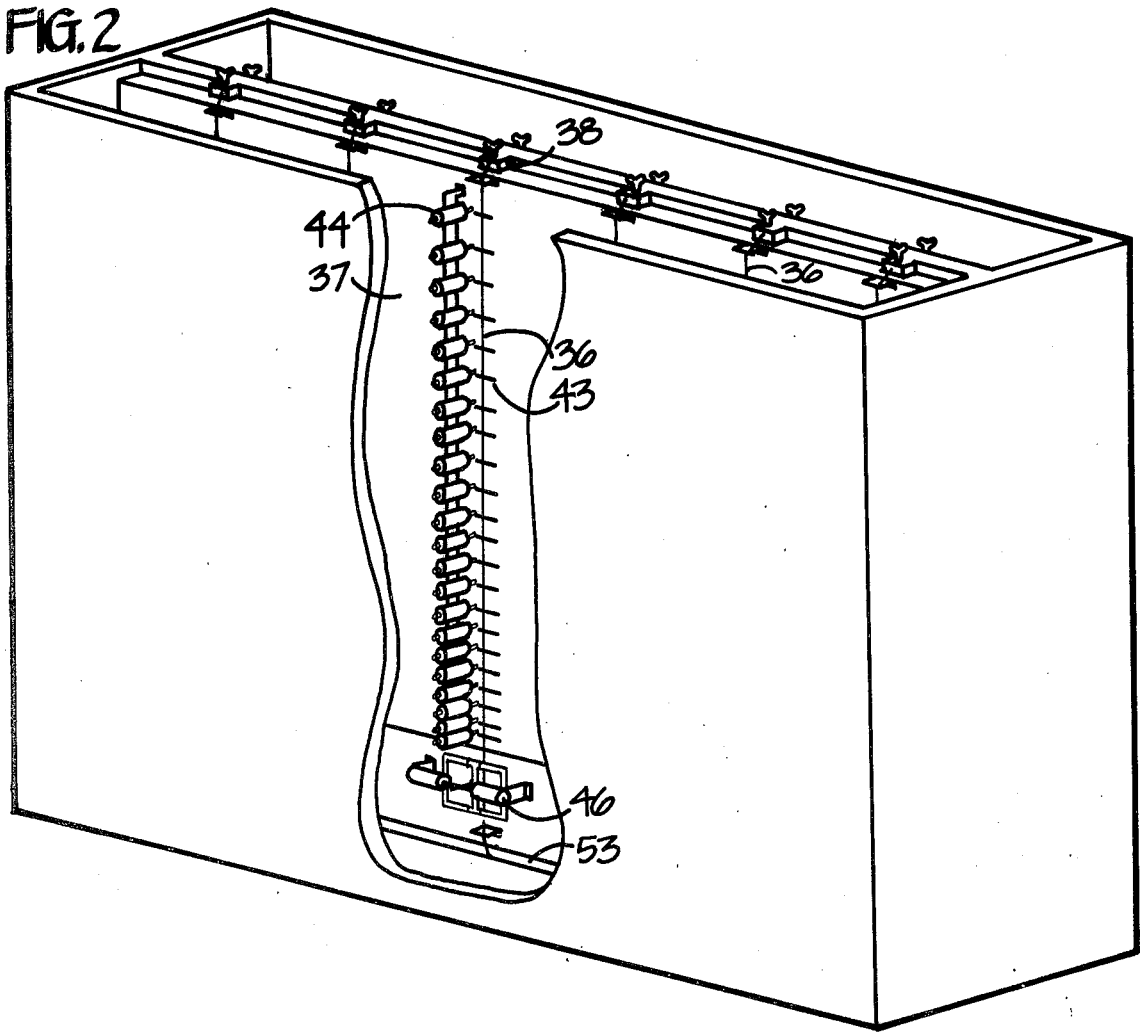
FIG. 2 is a perspective view of the enclosure containing the strings and related mechanics in accordance with the preferred embodiment.

In the preferred embodiment, the enclosure containing the strings is distinct from that containing the keyboard. FIG. 2 illustrates the preferred method where the strings (36) are mounted vertically on a warp resistant board (37). There is an equal number of strings on each side to equalize the stress on the board. The strings are tuned with standard guitar tuning keys (38) located at the top of the enclosure and easily accessible to the musician. Because the mounted strings are positioned in an enclosure affording ample space and weight capability, it is practical that the worm gear of each standard tuning key can be directly engaged with electromechanical means, for best results a motor, which in conjunction with associated circuitry can automatically achieve proper tuning.

Figure 3:
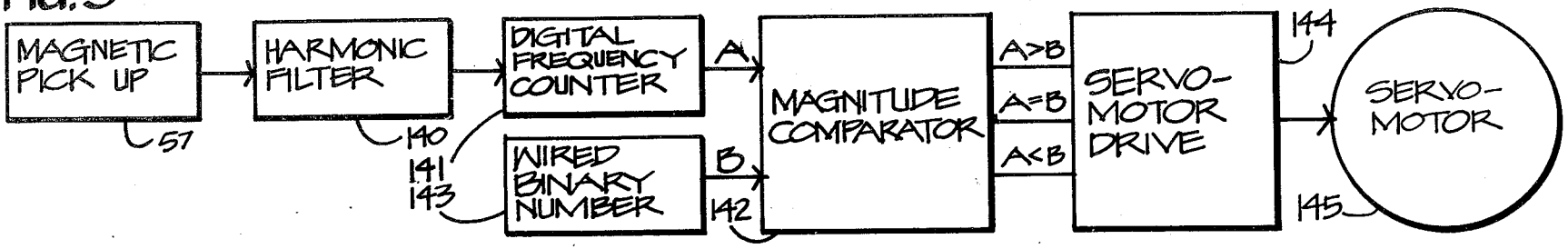
FIG. 3 is a schematic diagram of the automatic tuning system.

FIG. 3 illustrates this automatic tuning system. Upon activation of the tuning process, the audio output of a string, as generated in magnetic pick up (57), is routed through harmonic filter (140), which reduces the audio signal to the desired harmonic. This is routed to digital frequency counter (141), which provides a binary output to magnitude comparator (142). This is compared with the ideal value (143), which is in wired binary form. The A and B signals may denote the string's frequency per se; however, for best results these signals are representative of the duration of some set number of periods. Servo motor (145) is preferably a reversible D.C. motor; therefore, servo motor drive (144) provides D.C. current of one polarity in response to signal $A>B$, and of the opposite polarity in response to signal $A<B$, and no current in response to signal $A=B$. $A>B$ results in the slackening of the string. $A<B$ results in the tightening of the string. Although a digital system, as illustrated, is most practical, it is obvious that the analog equivalent of this system would operate sufficiently.

Figure 4:
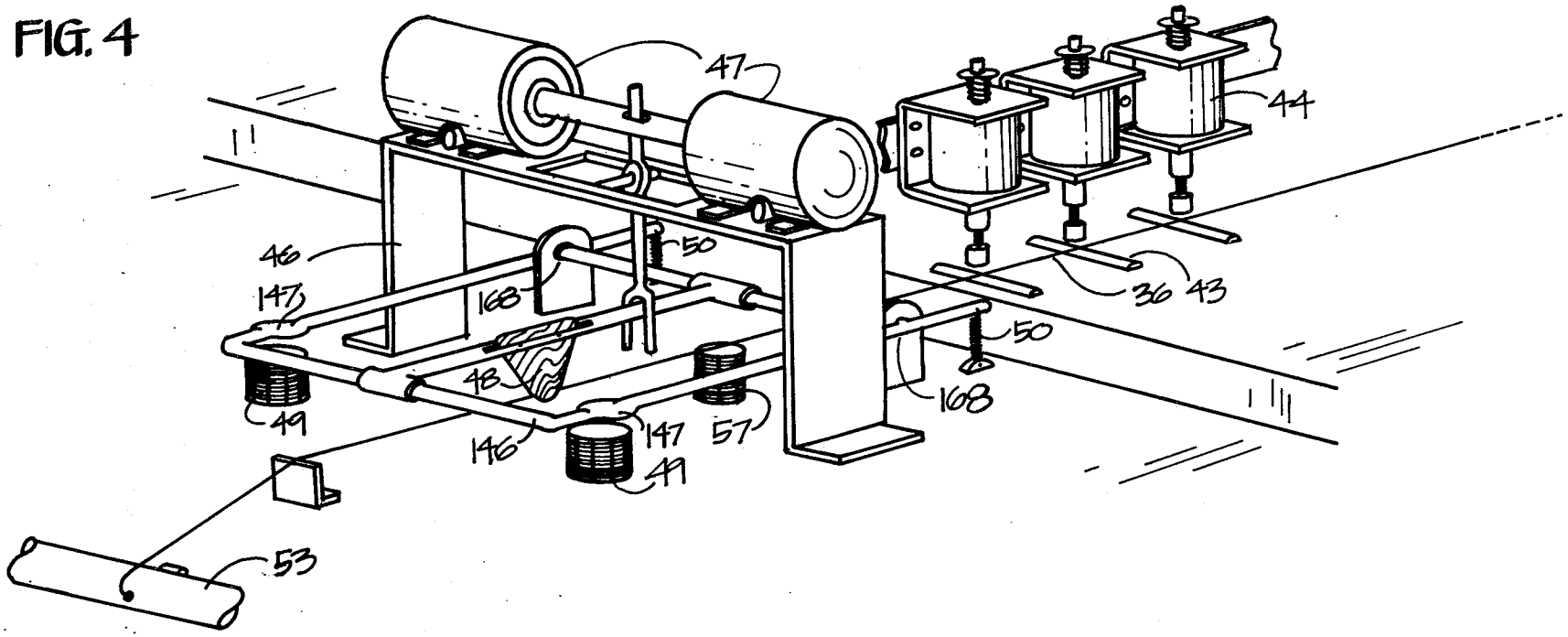
FIG. 4 is a perspective view of a single string and its related mechanics in accordance with the preferred embodiment.

FIG. 4 is a perspective view of a single string and its related mechanics in accordance with the preferred embodiment. Frets (43) correspond to the frets of a standard guitar. Push-type fretting solenoids (44) are positioned outwardly from every fret position, so that when one fretting solenoid is energized, it depresses the string (36) against its associated fret, thereby shortening the string's vibrating length. Because the fretting solenoids are fixed in position, it is possible that frets not be used, and that the tuning be established by the precise positioning of the fretting solenoids. However, in the preferred embodiment the use of frets is employed for precision and consistency of pitch. Unlike a standard guitar, wherein one fret is common to all six strings, on this instrument each fret is associated with only one fret position of one string. In the preferred embodiment the frets can be adjusted slightly in position to compensate for any slight straining or warpage of the mounting board which would affect the tuning.

Concurrent to any fretting solenoid (44) being energized, the related plucking solenoid assembly (46) is activated. The plucking solenoid assembly comprises two pull-type solenoids (47) mounted in opposing directions. When it is established that the string be plucked, one of the solenoids is energized. By illustrated mechanical connection, plectrum (48) is thereby swept across the string. When the resistive force offered by the string is sufficient to cause said plectrum to flex, it does so, thereby plucking the string. The next time the string is to be plucked the other solenoid is energized, sweeping said plectrum across the string in the opposite direction. Hence, these solenoids alternate in duty. Rectangular assembly (146) swivels at points (168). Said rectangular assembly preferably has its proximity to string (36) established by the force of extension springs (50) opposing the force of magnetic attraction between electromagnets (49) and the flattened portions (147) of rectangular assembly (146). Thus, the degree of current to electromagnets (49) is directly related to the depth at which plectrum (48) engages string (36), and, therefore, to the intensity of the resulting pluck. Solenoids (47) may both be push-type as well.

The intensity of said pluck is preferably dictated by the speed at which the related key is depressed. This is accomplished through the use of detectors which, in conjunction with related circuitry, translate the downward velocity of the key into an electrical current sufficient to drive electromagnets (49). Alternatively, the intensity of the plucking of all strings can be non-selectively dictated by a single pedal control which regulates the positions of all rectangular assemblies (146).

One means whereby the intensity of the pluck may be dictated by a single pedal control consists of electrically joining all electromagnets (49) associated with every string. The current to said electromagnets can be regulated by a variable resistor engaged with said pedal control.

Figure 5:
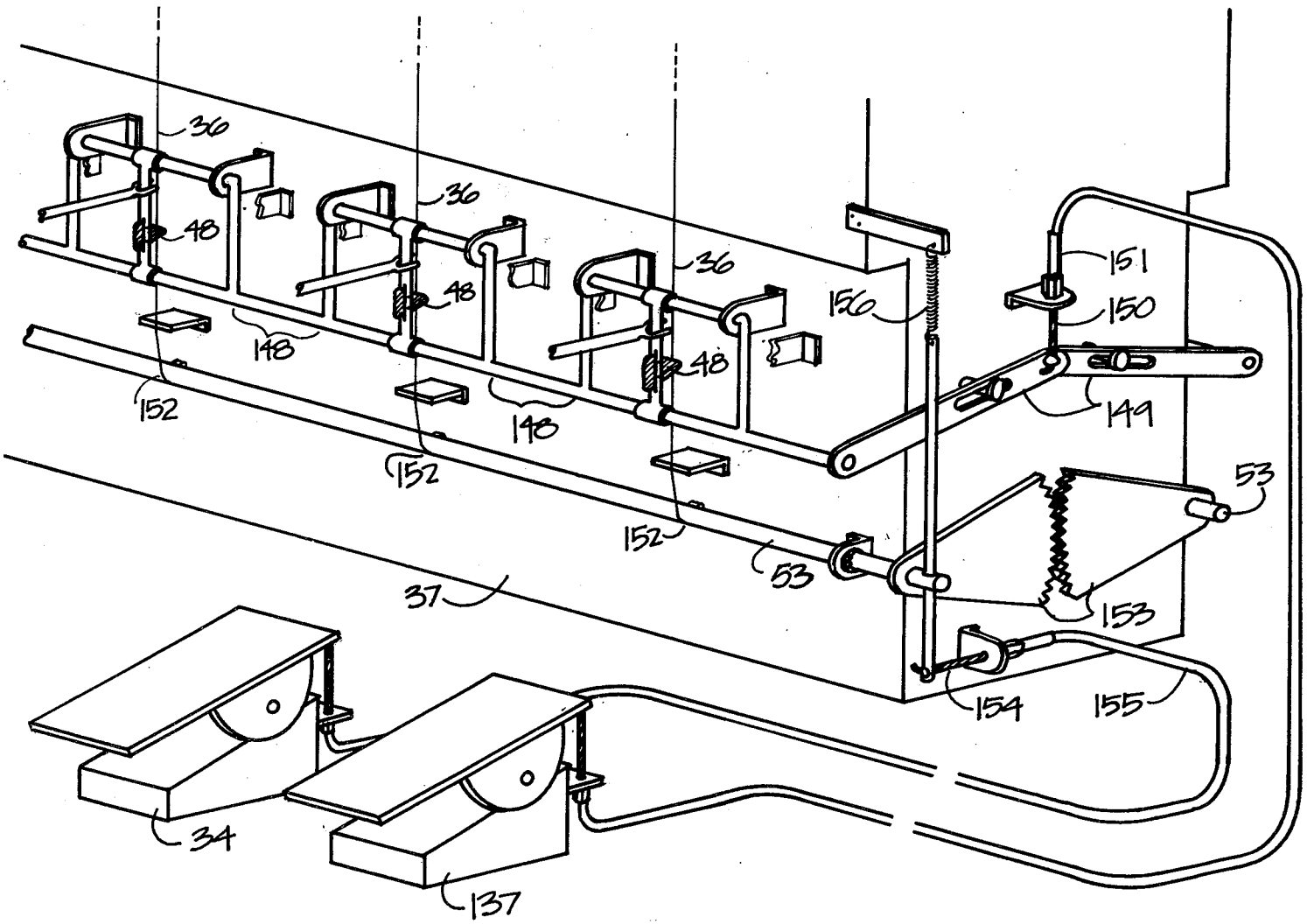
FIG. 5 is a perspective view of several strings and their related mechanics, illustrating an alternative means for controlling the pluck intensities.

FIG. 5 illustrates an alternative means whereby the intensity of the pluck can be dictated by a single pedal control. As illustrated, all rectangular assemblies on each side of mounting board (37) are physically joined by sections (148), creating a single structure on each side. Said single structures from both sides are connected by rods (149) to flexible cable core (150) which is surrounded by outer casing (151). Said flexible cable core and outer casing are connected to pluck intensity pedal (137) so as to transfer the movements of said pluck intensity pedal to said single structure.

The bases of the strings on each side of mounting board (37) are secured to rotatable bar (53) by means of eyelets (152) diametric to said rotatable bar, through which said strings are passed, then doubled back, partially circumvoluting said rotatable bar. When rotated a few degrees, depending on the direction, the strings are either tightened or loosened. This respectively sharpens or flattens the tones. Gears (153) enable rotatable bars (53) from both sides of mounting board to rotate in unison. Flexible cable core (154), which is surrounded by outer casing (155), is engaged with said rotatable bars, and with tremolo pedal (34), so as to transfer the movements of said tremolo pedal to said rotatable bars (53). Extension spring (156) causes rotatable bars to return to a neutral position in the absence of force applied to tremolo pedal (34).

Figure 5A:
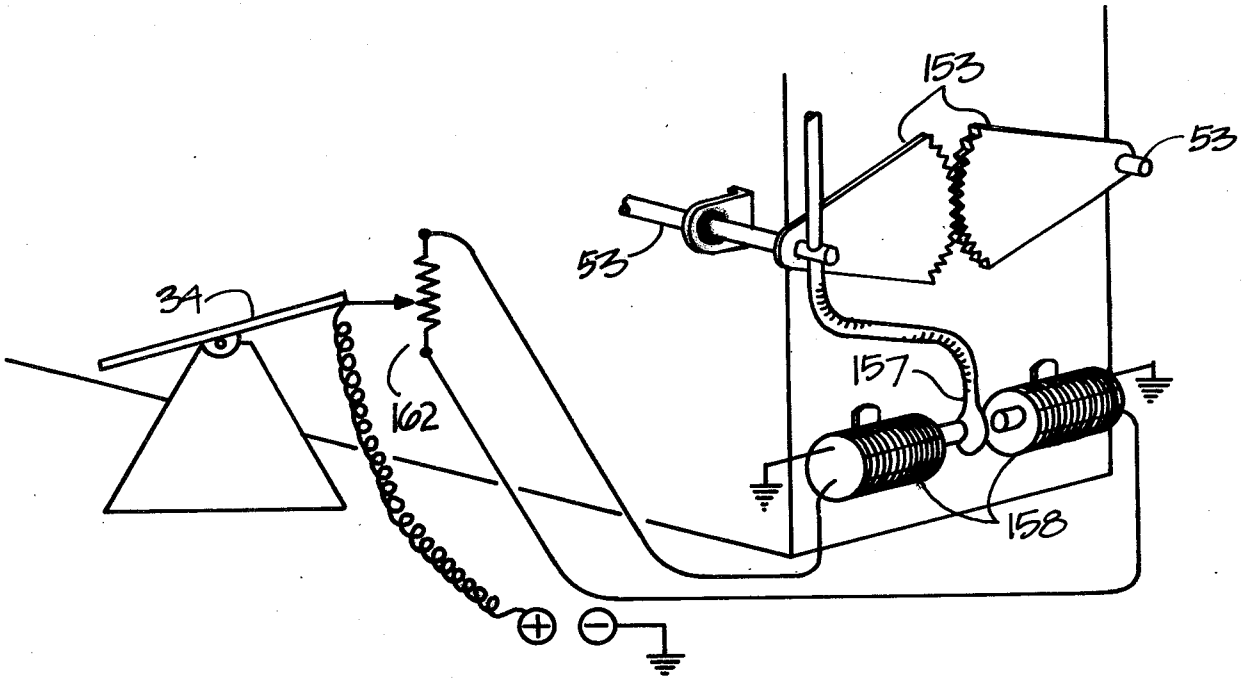
FIG. 5A is a partial perspective view of the tremolo system, illustrating symbolically electrical control thereof.

FIG. 5A illustrates an alternative means whereby the rotatable bars can be controlled by the magnetic attraction between flattened bar (157) and electromagnets (158). Said electromagnets have their current regulated by potentiometer (162) which is engaged with tremolo pedal (34).

Magnetic pick up (57) converts the string's vibrations into an electrical signal which is mixed with the equivalent outputs from other strings. This composite is then amplified before driving speaker(s). In the preferred embodiment more than one pick up per string is used, and there is a facility to switch from one to another, thereby selecting the type of tone desired.

Figure 6:
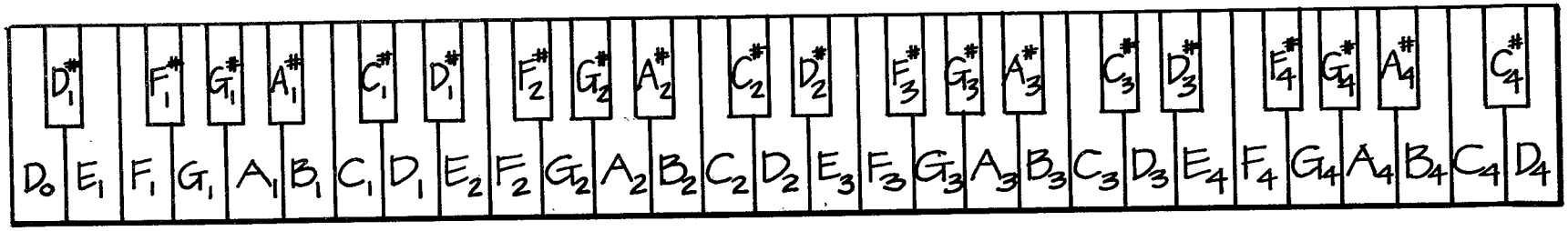
FIG. 6 is a chart illustrating the particular nomenclature regarding notes used in this specification.

FIG. 6 designates the particular nomenclature regarding notes used hereinafter in this specification. $D_o$ is representative of D-73.416.

Figure 7:
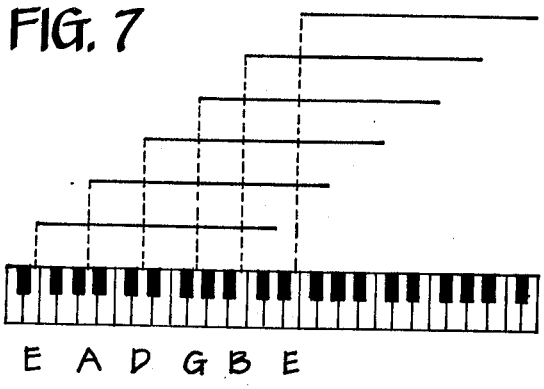
FIG. 7 is a chart plotting the strings of a guitar against a keyboard, illustrating their tunings and ranges.
Figure 8:
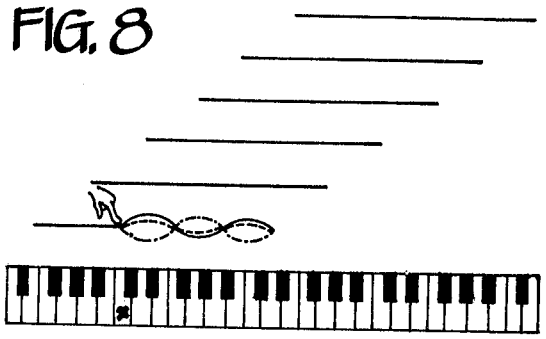
FIGS. 8 and 8A show two possible ways in which a guitarist may sound $C_1$.
Figure 8A:
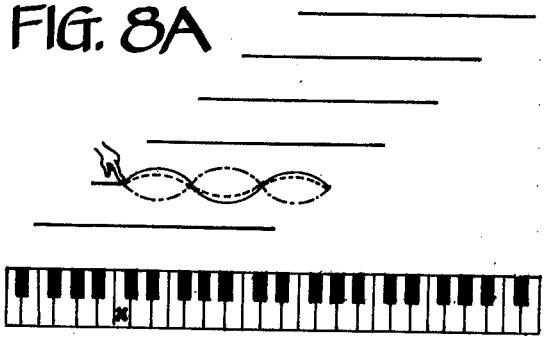

FIG. 7 plots the six strings of a standard, twenty-two fret guitar against a keyboard for the purpose of illustrating the tunings and ranges of each string. They are tuned as follows: E-82.407; A-110.000; D-146.832; G-195.998; B-246.942; E-329.628. Unlike a piano or harpsichord, in which the number of strings (or sets of strings) equals the number of notes, the guitar has only six strings for its forty-seven notes. Referring to FIGS. 8 and 8A, when the guitarist wishes to sound $C_1$, for example, he plucks the string with his right hand, and makes the vibrating portion of the string its proper length (frets) with his left hand. As is apparent for $C_1$, the guitarist has two strings at his option. Both of these are capable of producing this pitch. However, if one of these strings is already sounding another note, he must select the other string. And if both these strings are already in use, there is no way this note can then be sounded.

For my invention, where a keyboard electrically commands the mechanical playing of guitar strings, it is apparent that associated with each note there must be circuitry to select one of the strings and appropriate fret positions that note has at its option. Hereinafter, I will refer to the circuitry directly involved in the selection of a string and appropriate fret position for any individual note as an "individual note selector." The totality of individual note selectors, working in cooperation with themselves and other circuitry to be described later, constitutes the "fret and string selector system" (32) of FIG. 1.

Figure 9:
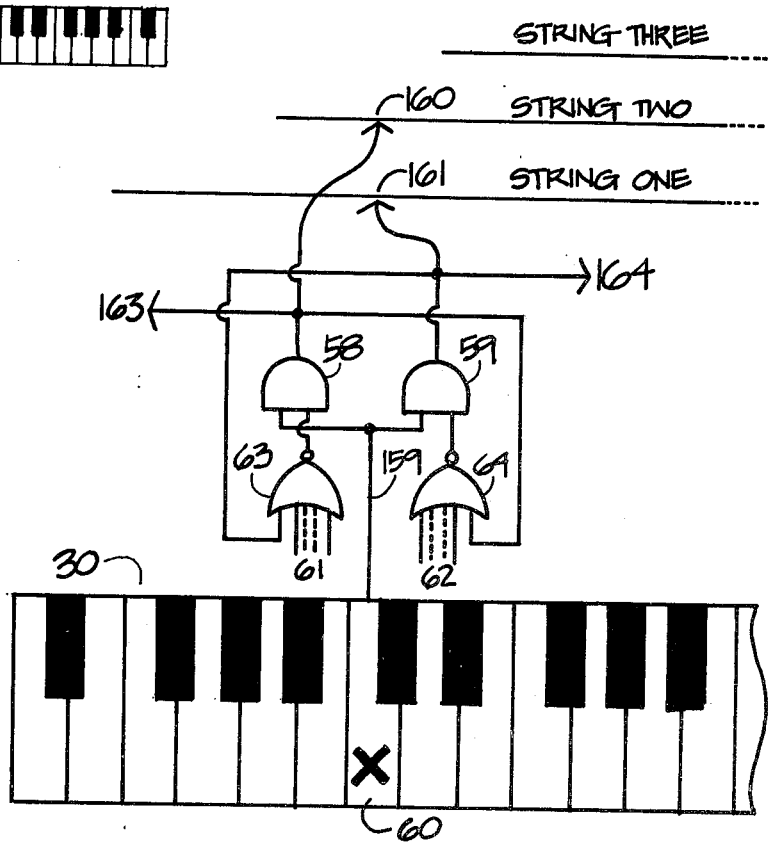
FIG. 9 is a schematic diagram of the individual note selector in its basic form.

FIG. 9 illustrates an individual note selector in its basic form. It is shown associated with the same $C_1$ (60) as illustrated in FIGS. 8 and 8A. The common input (159) to AND gates (58 and 59) has as its source the $C_1$ note (60) on the keyboard (30). A high signal is produced when the key is depressed. The outputs of AND gates (58 and 59) terminate at the two possible strings and appropriate fret positions (160 and 161) which will produce this desired pitch. Assume that a high signal, appearing on either of said outputs, denotes the selection of the corresponding string and fret position. In the initial state, the outputs of both AND gates (58 and 59) are low. When the key is depressed and common input (159) becomes high, a stable state is achieved when one output becomes high and the other low. The inputs (61) to NOR gate (63) represent the signals which are counterparts to signal (163), derived from all the AND gates other than (58) which are associated with a fret position on string two. The inputs (62) to NOR gate (64) represent the signals which are counterparts to signal (164), derived from all the AND gates other than (59) which are associated with a fret position on string one. Thus, if this individual note selector selects string one, all other individual note selectors are inhibited from selecting string one. Likewise, if string one is already in use, the individual note selector associated with $C_1$ is inhibited from selecting string one. The same applies for string two. Note that in its basic form the individual note selector's function is merely to route the signal from the key to an arbitrary fret position at its option. In other words, no string is given priority over another.

In such an embodiment comprising guitar strings identical in number and in tuning to a standard guitar, there necessarily must be present the same limitations present in a guitar. There is a limitation as to how many notes can be sounded simultaneously. Obviously, a six-string instrument can sound a maximum of six notes at a time. Also there is a limitation as to which notes can be sounded in combination with others. It is impossible to sound together, for instance, the two notes shown in FIG. 10 because a sole string is common to both these notes. Many chords, such as the four-note chord shown in FIG. 10A, are impossible to sound because there are only three strings which fall in this range.

Therefore, in the six-string embodiment the musician finds the instrument not totally responsive to his playing because of these limitations just mentioned. It is the object of the preferred embodiment that the keyboard can be played in a normal organ or piano style and be completely responsive; that is, the chords played on the keyboard have all of their contained notes sounded on strings. This is accomplished by utilizing twelve strings tuned as follows: D-73.416, F-87.307, G-97.999, G-103.826, C-130.813, D-155.563, F-174.614, A-220.000, C-277.183, E-329.628, E-329.628, E-329.628 (FIG. 11); and by utilizing individual note selectors which have assigned to each option a definite priority. Some of these individual note selectors are able to reassign priorities to each option in response to changing conditions. These conditions relate to: (1) the keys which are being depressed on the keyboard; and (2) the strings which are being used.

To show how the use of individual note selectors, which have assigned a priority to each option, is effective in providing strings for all of the notes contained in full chords, it is necessary to clarify what occurs when a chord is played on the keyboard. Although it may appear to the musician that all the keys are depressed at the same instant, there is always some time interval between such seemingly simultaneous events. Consequently, the signals from the keys appear one after another at their respective individual note selectors. If these individual note selectors were to make their selections randomly, perhaps a leftover note with no vacant string available to it would occur. But if each has its selection directed by a logical set of priorities, probably no leftover note with no vacant string available to it would occur.

As an example: FIG. 12 illustrates a three-note chord. Suppose $D_o$, $F_l$, and $A_l$ were depressed on the keyboard and happened to make contact first to last from right to left. If the individual note selectors made their selection randomly, $A_l$ might select string 2. Then $F_l$ would select string 1. Then when $D_o$ made contact it would have no string available to it.

FIG. 13 illustrates the preferred priority assigned to each option of each of these three notes. It is illustrated here that $A_l$ has as its first priority, string 4. This means that $A_l$ will select string 4 instead of strings 3, 2, or 1, unless string 4 is already being used. If it is being used, $A_l$ will resort to its second priority, string 3, unless string 3 is being used. If it is being used, $A_l$ will resort to its third priority, string 2, unless string 2 is being used. If it is being used, $A_l$ will resort to its fourth priority, string 1. The priorities for $D_o$ and $F_l$ are charted in the same way.

Given the same order of occurrence, FIG. 14 illustrates which strings would be used for each of said three notes if their individual note selectors abided by the priorities illustrated in FIG. 13. When $A_l$ made contact its first priority would be selected, string 4. When $F_l$ made contact its first priority would be selected, string 2. When $D_o$ made contact, string 1 would be available to it. Thus, the priorities were established with consideration for the possibility that a large chord could be forthcoming. There was another consideration in establishing these priorities-- that is, that a note not be placed on a string with a very short vibrating length unless necessary. This will produce a tone with poor timbre.

For best results each of the individual note selectors in the low area from $D_o$ to $B_l$ makes its selection in accordance with an unchanging set of priorities which is biased to select the higher strings first, and to conserve the lower strings. This was just exemplified. Most of the individual note selectors in the remaining area, and particularly in the middle area from $F_2$ to $G_4$, have several pre-established (wired) sets of priorities, each of which is biased differently. One may be biased to conserve the higher strings. Another may be biased to conserve the lower strings. And another may be biased to select one of the middle strings first. These individual note selectors quickly change from one set of priorities to another in response to changes relating to which keys are being depressed and which strings are being used.

Figure 15:
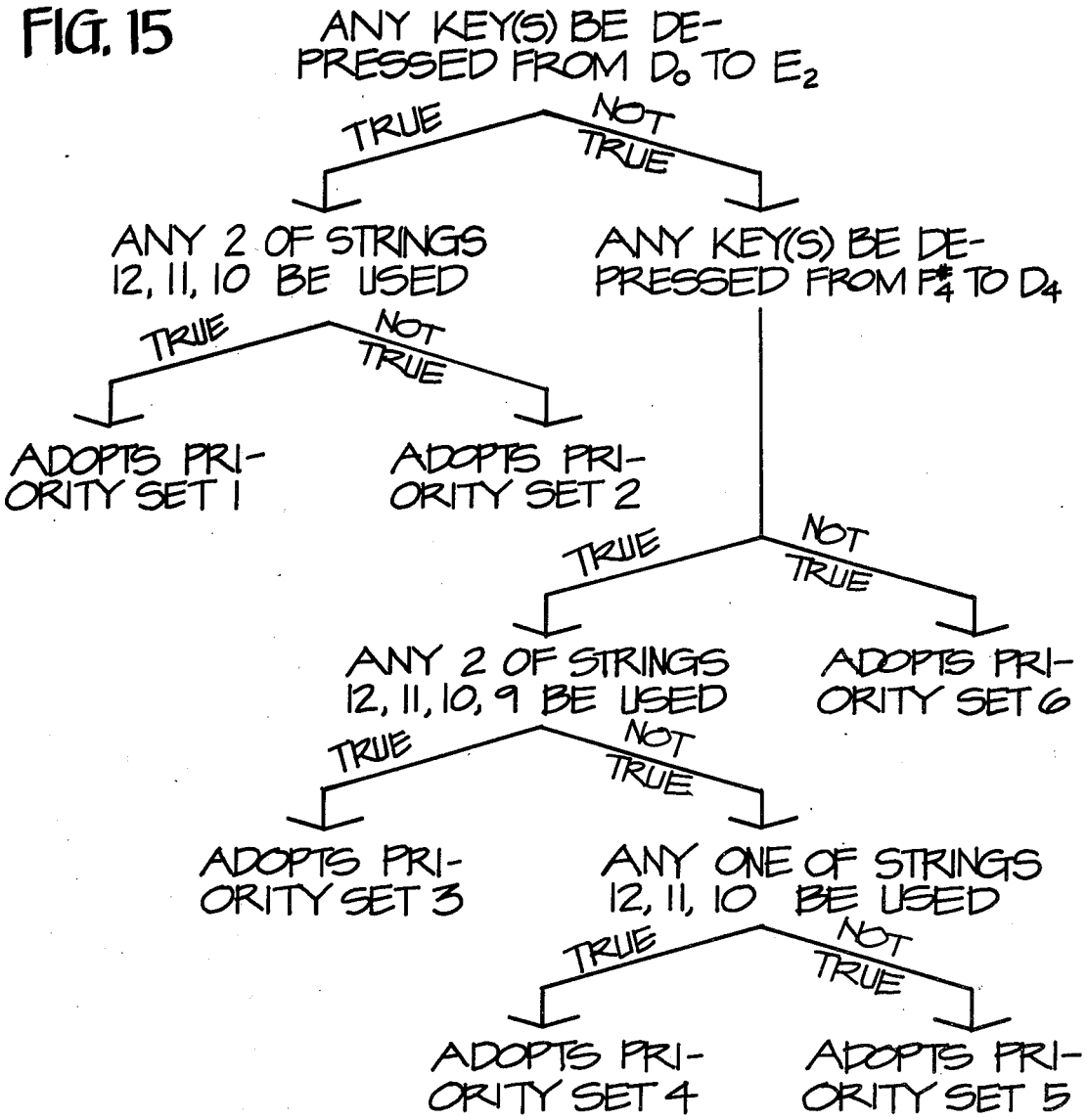
FIG. 15 is a chart showing the logic by which $A_3$ abides, in accordance with the preferred embodiment.

As an example, FIG. 15 illustrates the logic whereby $A_3$ adopts a set of priorities with regard to its options. Starting at the top there is the condition "any key(s) be depressed from $D_o$ to $E_2$ [inclusive]." Suppose this condition is met, then proceeding left and downward, the next relevant condition is "any two of strings 12, 11, 10 be used." Suppose this condition is not met, then priority set number 2 is adopted. With the adoption of priority set number 2, string 12 will be selected if it is vacant. If it is being used, string 9 will be selected if it is vacant. If both strings 12 and 9 are being used, string 8 will be selected if it is vacant. But if strings 12, 9, and 8 are being used, string 11 will be selected. Priority set number 2, more than any other priority set, is biased to conserve low strings. Priority set number 3, more than any other priority set, is biased to conserve high strings. Priority sets 1, 4, 5, and 6 give first priority to the strings which are more in the middle.

In summary, in the preferred embodiment all of the individual note selectors have at least one set of priorities. Many individual note selectors, particularly in the area from $F_2$ to $G_4$, have several sets of priorities, and are able to change from one to another in response to changing conditions. This arrangement affords the most logical selection of strings as directed by the sequential closing of key contacts in the playing of a chord, reducing the likelihood that the final note(s) of the chord to make contact will not have available a string on which to sound.

However, if this situation should arise, there is one more aspect of the fret and string selector system that corrects any problem involving a note which does not have a vacant string available to it. This circuitry, hereinafter referred to as the "'error' corrector," senses this situation and then sends a command sequentially to all of the individual note selectors. The command causes each individual note selector to reselect a string at its option. Because at this point all of the contacts associated with the notes in the chord are closed, the individual note selectors have probably adopted priority sets which are biased more to conserve strings which extend into the area where there is the note with no vacant string available to it. As soon as all notes have a string on which to sound, this operation of commanding individual note selectors to reselect is halted. If this condition was the result of the musician striking a chord in an unbroken manner, then this "error" correcting action would have taken place before the fretting and plucking solenoids start to move, and so be unnoticeable. However, if this was the result of the musician depressing keys and holding them one after another, when he finally depresses his last key, which has no vacant string, roughly as few as possible of the notes which are sounding will be relocated. This would be noticeable, though not very objectionable, and would occur rarely.

Figure 16:
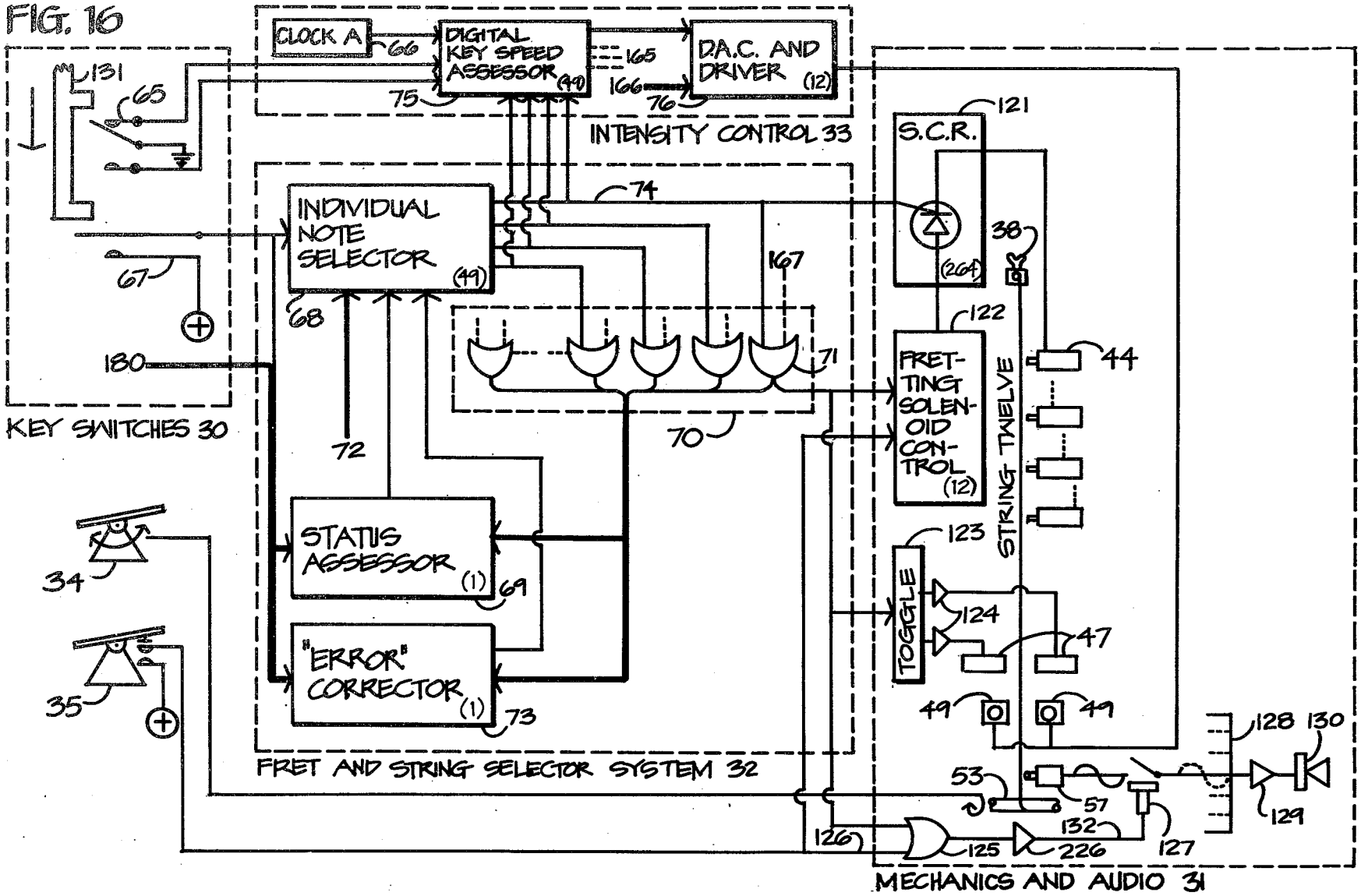
FIG. 16 is an overall schematic diagram of the preferred embodiment, showing greater detail than FIG. 1.

FIG. 16 illustrates in detail the overall diagram of the preferred embodiment, shown without detail in FIG. 1. FIG. 16 specifically illustrates the route of $B_4$. There are several boxes shown in FIG. 16 which are representative of sub-systems. These are all described and illustrated in detail later in the specification. The number in parentheses in the lower righthand corner of each of these boxes represents the number of times the particular sub-system occurs.

Under each key (131) there are two switches, one being a single-pole-double-throw, break-before-make switch (65). This switch relates to the intensity control (33). The other is a single-pole-single-throw, normally-open switch (67). This switch relates to the fret and string selector system (32). I will describe said fret and string selector system first. When a key is depressed the single-pole-single-throw, normally-open switch (67) closes. The signal produced travels to the individual note selector (68). All forty-nine keys have associated with them an individual note selector. The individual note selector for $B_4$ has at its option fret positions on four strings, 12, 11, 10 and 9, which are capable of producing this desired note.

Also coming into the individual note selector (68) is information from the status assessor (69). This information is the basis whereby the individual note selector adopts a set of priorities with regard to its four options. This information, in the form of "yes" or "no" (high or low), may relate to the status of the keys which are being depressed and/or the strings which are vibrating. (It happens that $B_4$ derives information concerning only the latter.) Consequently, the status assessor (69) has fed into it information (180) from the forty-nine single-pole-single-throw key switches (67), and also information from the twelve OR gates (70) which represent the status of the twelve strings.

Flowing into each of said OR gates are the related outputs of twenty-three individual note selectors which have at their option a fret position or open position on that string. Therefore, if any individual note selector selects string 12, for example, the output of OR gate (71) associated with string 12 will become high. Dotted input (167) represents the twenty-two other inputs derived from other individual note selectors.

Also coming into the individual note selector is information (72) regarding the status of the four strings it has at its option. Obviously, if a string is already being used, the individual note selector must avoid selecting this string. This information (72) is similar to that produced by OR gates (70), just explained, except that instead of representing all twenty-three fret positions and open position, these inputs (72) represent the twenty-two other (not including its own) fret positions and open position of these four strings.

Finally, coming into the individual note selector is a signal from the "error" corrector (73). The "error" corrector detects a situation where more keys are being depressed than strings are sounding. It corrects this situation by sending a command to the individual note selectors directing them to reselect.

If, when the individual note selector (68) is activated, it in turn selects the fret position on string 12, as illustrated in FIG. 16, this signal on the string 12 output (74) implements the proper fretting and, via OR gate (71), the plucking of string 12. Signal (74) also is routed to all other individual note selectors which have string 12 at their option, inhibiting them from selecting string 12. Signal (74) also directs the digital key speed assessor (75) associated with $B_4$ to transfer its data regarding the desired intensity of the pluck to the digital-to-analog converter and driver (76) associated with string 12. Signals (165) terminate at the digital-to-analog converter and drivers associated with strings 11, 10 and 9. Signals (166) are derived from the other digital key speed assessors associated with individual note selectors having string 12 at their option.

Figure 17:
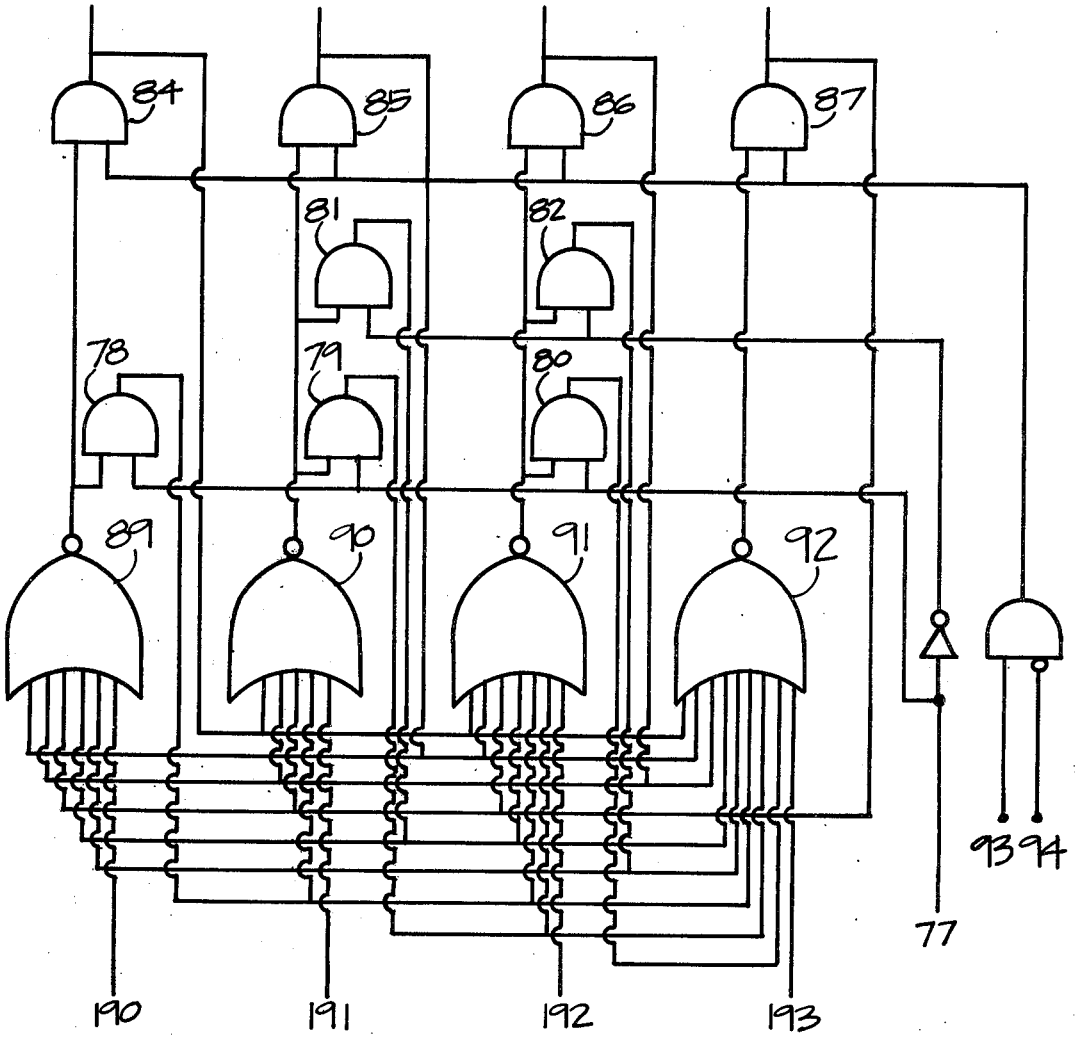
FIG. 17 is a schematic diagram of the individual note selector of $B_4$ in accordance with the preferred embodiment.
Figure 18:
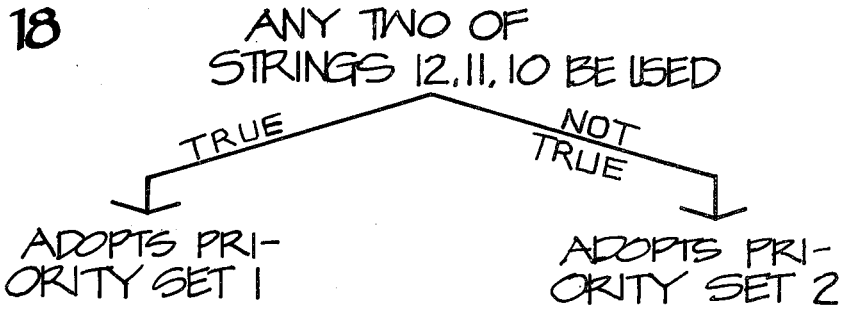
FIG. 18 is a chart showing the logic by which $B_4$ abides, in accordance with the preferred embodiment.

FIG. 17 illustrates in detail the individual note selector of $B_4$ (68) which is shown without detail in FIG. 16. FIG. 18 illustrates the logic employed by $B_4$. Reference is now made to FIG. 17; a high signal on the output of AND gate (84), (85), (86) or (87) signifies the selection of string 9, 12, 11 or 10, respectively. NOR gates (89), (90), (91) and (92) are configured so that any high input thereto will inhibit the selection of that NOR gate's associated string. Inputs (190), (191), (192) and (193) represent the ORed composite of all signals, from other individual note selectors, which signify the selection of strings 9, 12, 11 and 10, respectively. Signal (77) is derived from the status assessor (not shown in FIG. 17). Signal (77) is high if any two of strings 12, 11 or 10 are being used, and low if they are not being used. When signal (77) is high, a high signal appears at the inputs of AND gates (78), (79) and (80). When signal (77) is low, a high signal appears at the inputs of AND gates (81) and (82). Thus, when signal (77) is high, string 9 has priority over strings 12, 11 and 10. String 12 has priority over strings 11 and 10. String 11 has priority over string 10. When signal (77) is low, string 12 has priority over strings 11, 10 and 9. String 11 has priority over strings 10 and 9. It is not necessary to establish priority between strings 9 and 10 because if signal (77) is low, then at least one of the two strings, 12 and 11, is necessarily vacant.

Before the $B_4$ key is depressed, a high signal is being supplied to only one of the AND gates (84), (85), (86) and (87). This AND gate is associated with the vacant string having the highest priority at that moment. When $B_4$ key is depressed, point (93) becomes high. If point (94) is not also high, then one of the four AND gates (84), (85), (86) and (87) will have its output become high, and in doing so latch itself into a high state by inhibiting the three other AND gates via their associated NOR gates (89), (90), (91) and (92). This latched high AND gate will then remain high until the $B_4$ key is released, and point (93) becomes low. Note that when one of the four AND gates (84), (85), (86) and (87) has its output latched in the high state, a change in priority will not cause it to go low. When the "error" corrector is activated, a high pulse arrives at point (94). The resulting momentary break causes the individual note selector to reselect a string. This reselection is based on which vacant string at that moment has the highest priority.

Figure 19:
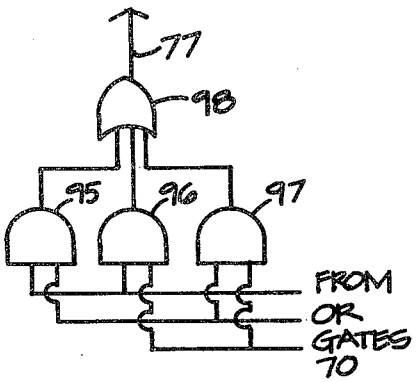
FIG. 19 is a schematic diagram of the portion of the status assessor which is relevant to $B_4$ in accordance with the preferred embodiment.

FIG. 19 illustrates in detail the portion which is relevant to $B_4$ of the status assessor (69) shown without detail in FIG. 16. Coming into AND gates (95), (96) and (97) are signals derived from OR gates (70), of FIG. 16, which relate to the status of strings 12, 11 and 10. Thus, if any two of the strings 12, 11 or 10 are being used, the output of OR gate (98) will be high. This information (77) goes to many individual note selectors, of which $B_4$ is one.

Figure 20:
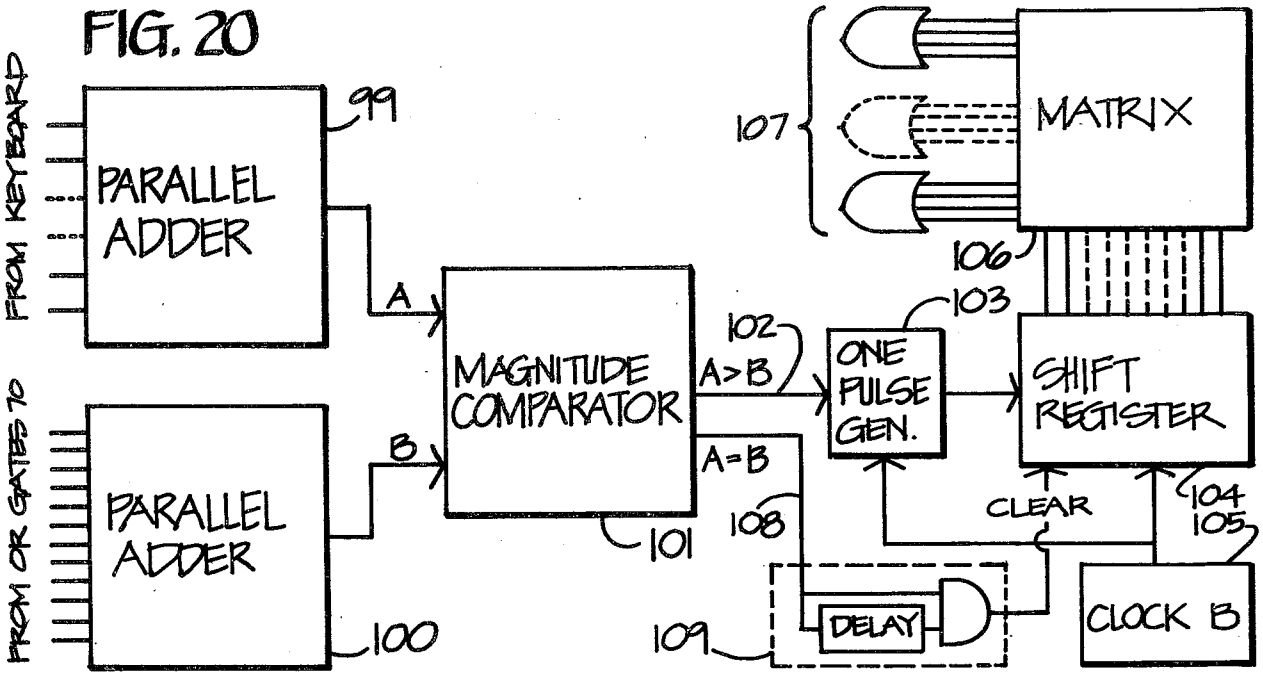
FIG. 20 is a schematic diagram of the "error" corrector in accordance with the preferred embodiment.

FIG. 20 illustrates in detail the "error" corrector (73) which is shown without detail in FIG. 16. Signals from the single-pole-single-throw key switches (67) of FIG. 16 arrive at parallel adder (99). Signals from the OR gates (70) of FIG. 16 arrive at parallel adder (100). The two sums are compared at magnitude comparitor (101). If a condition exists where more keys are being depressed than strings are being sounded, output A>B (102) will become high. This condition triggers one-pulse-generator (103) to feed one pulse into serial-in-parallel-out, sixty-one bit, shift register (104). Both the shift register and the one-pulse-generator are synchronized by clock B (105). The parallel outputs of said shift register may be considered the "Y" conductors of a matrix (106), having as its "X" conductors the inputs of forty-nine OR gates (107), each of which is associated with one of the forty-nine notes, and each of which has its output terminating at the point (94) of its associated individual note selector, as illustrated in FIG. 17. The matrix serves to distribute these pulses to the individual note selectors according to a pattern which is effective in eliminating this A>B condition, and which will cause roughly as few individual note selectors as necessary to reselect strings. FIG. 20A illustrates this pattern. The pulse from the first bit position of shift register (104) of FIG. 20 travels via matrix (106) through the two OR gates (107) associated with notes $G_1$ and $A_4$, onto the two individual note selectors associated with notes $G_1$ and $A_4$. Likewise, the pulse from the sixtieth bit position of shift register (104) travels via matrix (106) through the two OR gates (107) associated with notes $D\#_1$ and $D_4$, onto the two individual note selectors associated with notes $D\#_1$ and $D_4$. If and when during the course of this sequence the A>B condition is alleviated, the sequence is terminated by the A=B output (108) of magnitude comparitor (101) arriving at the clear input of shift register (104). The delay circuit (109) eliminates transient A=B conditions.

Figure 21:
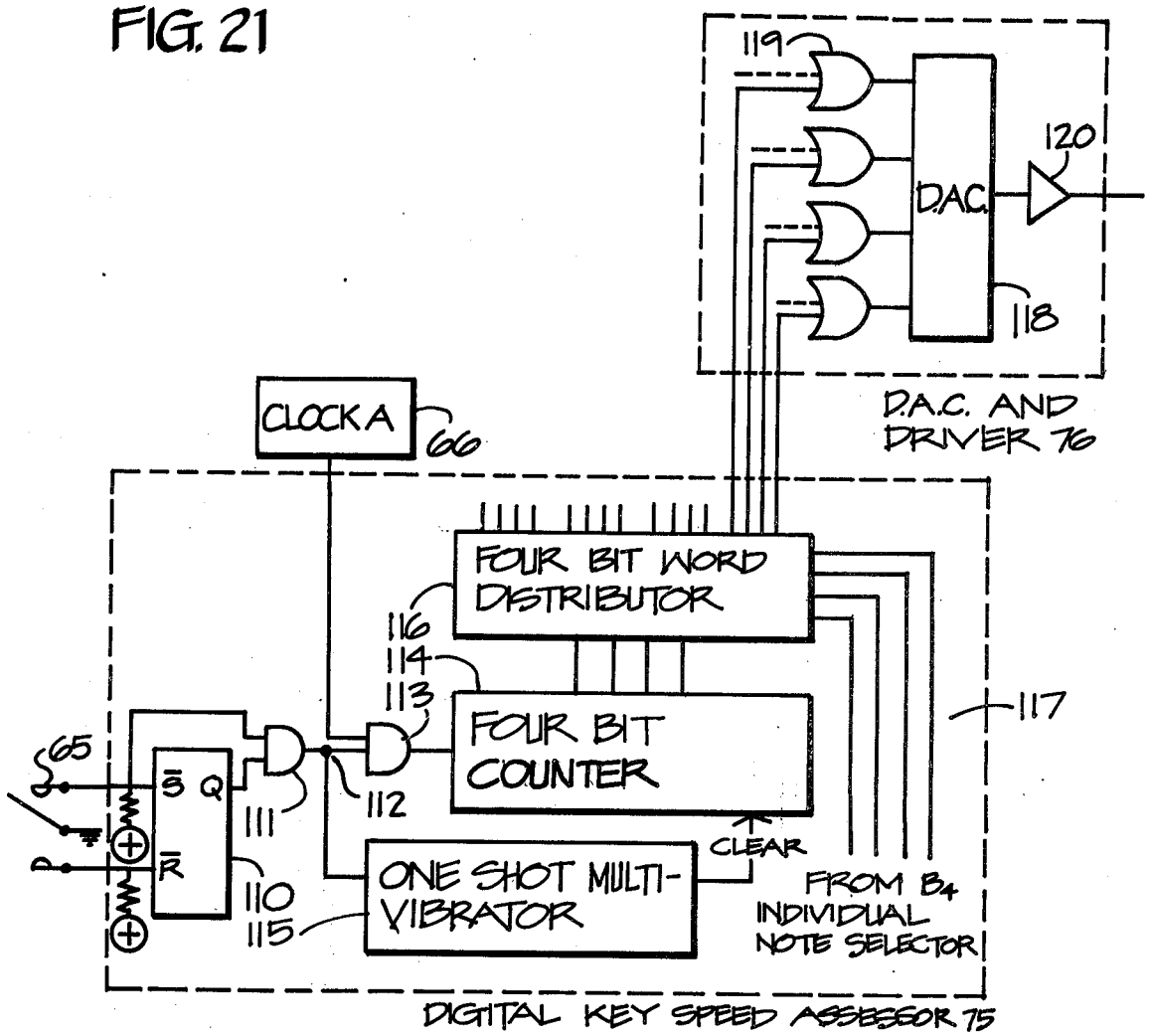
FIG. 21 is a schematic diagram showing the intensity control in accordance with the preferred embodiment.

FIG. 21 illustrates in detail the intensity control (33) illustrated without detail in FIG. 16. (110) is an R.S. flip-flop composed of two NAND gates. Flip-flop (110) and AND gate (111) are configured so that point (112) is high only during the time that the center contact of single-pole-double-throw, break-before-make switch (65) is descending, not in contact with the two extreme contacts. AND gate (113) "ANDs" point (112) with clock pulses from clock A (66), which is common to all forty-nine digital key speed assessors (75). This output of AND gate (113) is then accumulated in four-bit counter (114). The flow of pulses will continue until the center contact of switch (65) makes contact with the lower contact. Thus, a digital representation of the downward velocity of the key is created in four-bit counter (114). Of course, the counter can have any number of bit segments. A four-bit counter distinguishes between sixteen possible degrees of velocity where fifteen (binary 1111) represents the slowest and zero (binary 0000) the fastest. Through obvious circuitry, deleted for clarity, four-bit counter (114) is halted in its count should it reach fifteen. One-shot-multi-vibrator (115) very briefly clears the counter of its previous count at the beginning of the flow of pulses.

The four-bit word is distributed in parallel fashion, via word distributor (116), to one of the four possible digital-to-analog-converter and drivers associated with each of the four strings at $B_4$'s option. This distribution is directed by signals (117) from the individual note selector (68) of FIG. 16. Arriving at the digital-to-analog-converter and driver (76) associated with string 12, the word enters digital-to-analog-converter (118). All inputs to the digital-to-analog-converter are conveyed through OR gates (119). The output of digital-to-analog-converter (118) is then amplified via amplifier (120) to drive electromagnets (49) (not illustrated in FIG. 21).

When individual note selector (68) selects strings 12, as illustrated in FIG. 16, a signal then appears on the string 12 output (74). This signal then triggers silicone controlled rectifier (121) which will drive the proper fretting solenoid (44). This signal (74), via OR gate (71), also appears at toggle (123), which can be the trigger input of a J.K. flip-flop having its J. and K. inputs high. The outputs of toggle (123) are then amplified by amplifiers (124) which drive the plucking solenoids (47). Signal (74), via OR gate (71), also arrives at OR gate (125), as does the signal (126) from sustain pedal (35). The output of OR gate (125) is amplified by amplifier (226). The output (132) drives relay (127), which switches the audio circuit for string 12 "on." The audio signal generated at magnetic pickup (57) travels through relay (127), to audio bus (128), to main audio amplifier (129), to speaker (130). OR gate (125) provides that an audio signal will only arrive at audio bus (128) if the related key (131) is being held down, or if the sustain pedal (35) is depressed. Thus, the sustain pedal performs similarly to the sustain pedal of a piano.

It is obvious that an electronic switch may be used instead of relay (127). Or, instead of interrupting the audio signal, said signal can be shunted to ground. It is also possible that the string can be silenced mechanically instead of having its audio signal negated. This can be accomplished by signal (132), instead of driving relay (127), driving a solenoid which uses soft matter, preferably felt, to mute the string.

Figure 22:
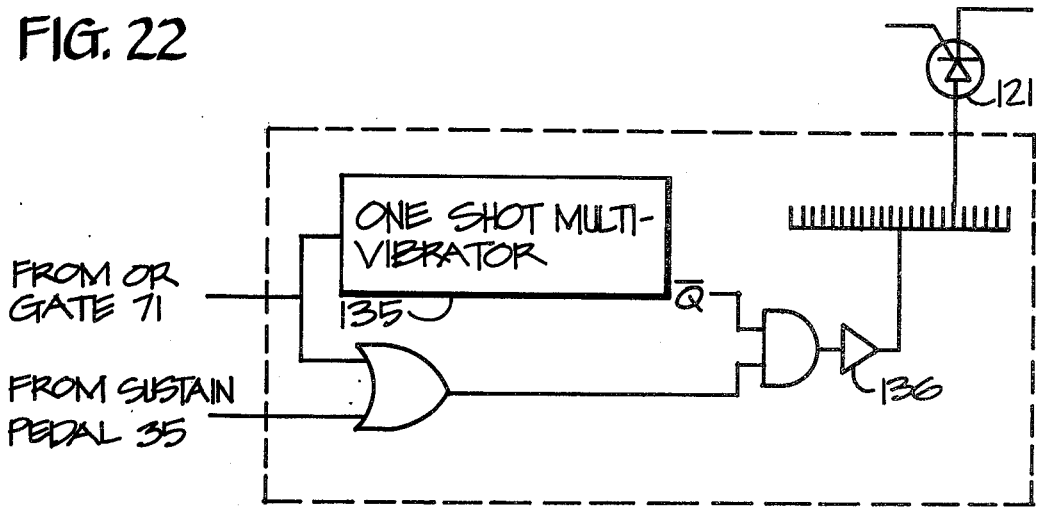
FIG. 22 is a schematic diagram showing the fretting solenoid control in accordance with the preferred embodiment.

A signal from the sustain pedal also arrives at the fretting solenoid control (122), as does a signal from OR gate (71). The fretting solenoid control, in combination with the silicone controlled rectifiers of its associated string, serves to sustain current to the proper fretting solenoid after the related key is released, if the sustain pedal is depressed. FIG. 22 illustrates in detail said fretting solenoid control (122) which is shown in FIG. 16 without detail. There are twelve such fretting solenoid controls, one associated with every string. A signal from OR gate (71), after a brief clearing by one-shot-multi-vibrator (135), produces a signal which is amplified through amplifier (136) to provide current to the silicone controlled rectifier (121) which has been triggered. The signal from sustain pedal (35) arrives at all fretting solenoid controls. If then the sustain pedal is depressed, the silicone controlled rectifier will remain on even after the related key is released.

Figure 23:
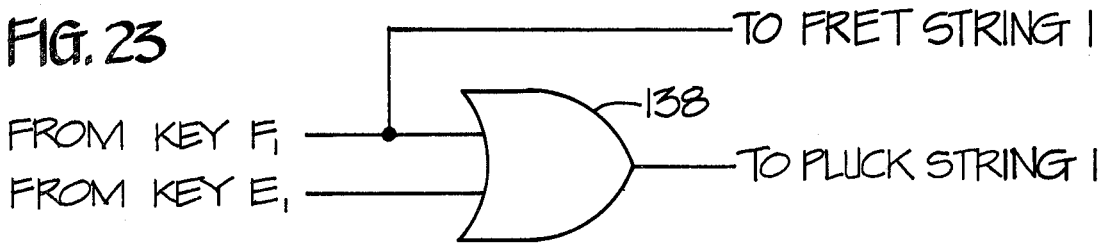
FIGS. 23 and 23A are schematic diagrams showing controlling electronic circuits in accordance with another embodiment of this invention.

In another embodiment every string is used only by two adjacent notes on the keyboard. Every string has only one fret and one fretting solenoid associated with it. This fretting solenoid changes the string's vibrating length to make it one-half step higher. Therefore, each string can produce two notes, one in the open position, and the other, a half step higher, in the fretted position. As a result, there are half as many strings as keys. Associated with a forty-eight note keyboard there are twenty-four strings. FIG. 23 illustrates how signals from the two adjacent notes are routed, via OR gate (138), to the plucking assembly associated with that string, and, when appropriate, to the fretting solenoid associated with that string. The drawbacks of this arrangement are that only one of the two adjacent notes sharing the same string can be sounded at one time, and there is a relatively large number of strings which require maintenance.

Figure 23A:
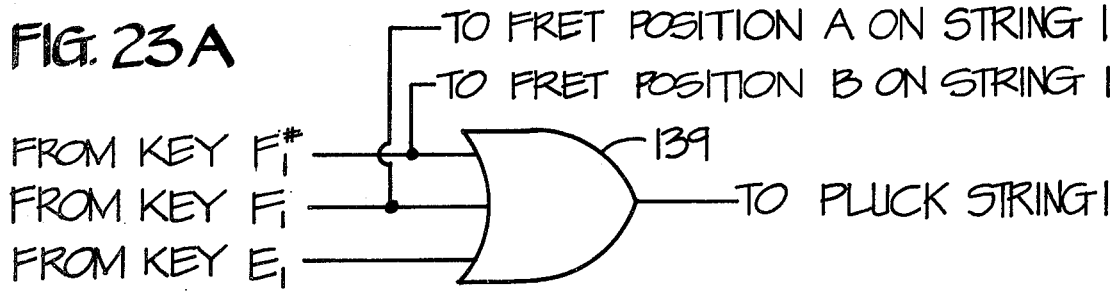

Taking this principle further, FIG. 23A illustrates how signals from three adjacent notes may be routed, via OR gate (139), to a common string. Each string has two fret positions; therefore, each string can produce three notes, one note in the open position, another note one-half step higher in fret position A, and another note still one-half step higher in fret position B. Consequently, there are one-third as many strings as keys. Associated with a forty-eight note keyboard there are sixteen strings. The drawbacks of this arrangement are that only one of the three adjacent notes sharing the same string can be sounded at one time, and there is a relatively large number of strings which require maintenance.

Each string can be shared by four adjacent notes in the same manner. However, the responsiveness of an instrument of this nature is inversely related to the number of adjacent notes which share a single string.

Figure 24:
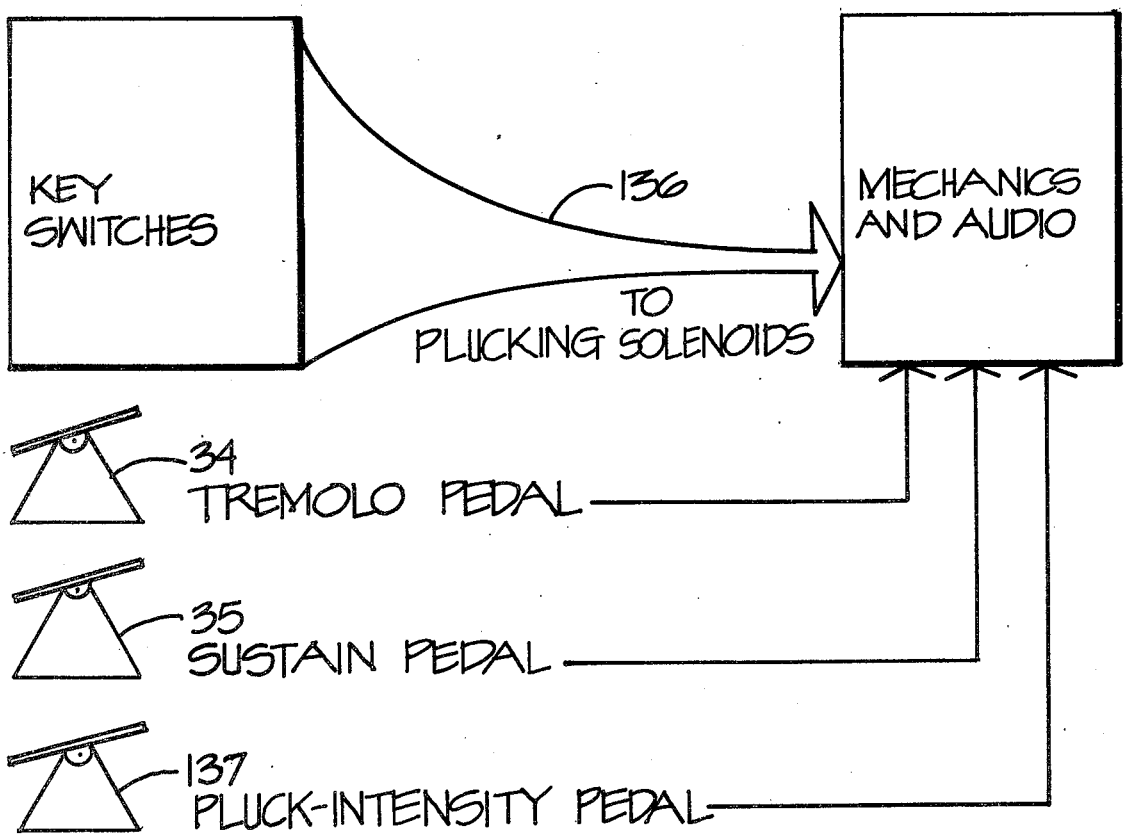
FIG. 24 is an overall schematic diagram of still another embodiment of this invention.

In the embodiment illustrated in FIG. 24 the number of strings equals the number of keys. This arrangement, while greatly increasing the number of strings, eliminates the need for frets, and the fret and string selecting system (32) of the preferred embodiment. Hence, there can be a direct electrical connection (136) between the keyboard and the circuitry (toggle, amplifier) regulating and driving the plucking assemblies. In some plucking mechanisms disclosed in the prior art there is no control circuitry employed; these mechanisms instead mechanically reposition the plucking implement proper in the "ready" position after each pluck. Such designs are generally more involved mechanically than the preferred method, and less able to respond to a rapid succession of electrical commands to pluck. If the plucking mechanism of the embodiment as illustrated in FIG. 24 is of this nature, there can be a direct electrical connection between the key switches and said plucking mechanisms.

In such an embodiment comprising this large number of strings of guitar gauge, it is exceedingly desirable that the tuning be accomplished by means of the automatic tuning system illustrated in FIG. 3. For example, when this instrument is played in the style referred to as "hard rock," it, as does a standard guitar, often requires tuning between every musical piece. Obviously, such an instrument with more than forty strings, each requiring hand tuning, is most impractical.

The operations of the tremolo pedal (34) and the pluck intensity pedal (137) are identical to said pedals' operations in the embodiments comprising fewer strings than keys. The operation of sustain pedal (35) is simplified in that it merely inhibits the otherwise automatic dampening of all strings.

It is fully comprehended that the use of a knee-operated lever, of such a type commonly used in electric organs and the like, may be employed in lieu of any of heretofore described pedal controls, whether in mechanical connection as through the use of a flexible cable core and outer casing, or in electrical connection, with instrument's mechanical means. Also it is obvious that any type of transducer, as well as a magnetic pick up, can be employed.

What is claimed is:

1. A musical instrument, comprising:

a plurality of strings, each string having associated therewith means for changing the vibrating length of said each string;

a keyboard including a plurality of keys, at least a portion of said keys having the note represented thereby capable of being sounded by any one of a group of strings;

switching means responsive to the depression of each key for generating a related electrical signal;

circuit means for routing each of said signals to actuate an appropriate length changing means, thereby selecting the string associated with said appropriate length changing means for sounding, said circuit means including note selector means responsive to the signals from each key of said portion of keys for selecting one string from said group of strings for sounding and for inhibiting a subsequent selection of said one string while said each key is maintained depressed; and sounding means responsive to said signals for causing said selected string to vibrate.

2. A musical instrument in accordance with claim 1 wherein said sounding means comprises, for each string, two confronting solenoids secured outwardly from the lower region of said string, having a common plunger with which a flexible plectrum is operatively engaged, whereby upon energization of one of said confronting solenoids said plectrum traverses said string in one direction and upon energization of the other confronting solenoid said plectrum traverses said string in the opposite direction; and said means for changing the vibrating lengths comprises a plurality of solenoids mounted outwardly from each of said strings along its length so that upon energization, the plunger of one of said solenoids can press against said string, thereby changing the vibrating length of said string.

3. A musical instrument in accordance with claim 2 further comprising frets secured to a string mounting structure at the vicinity of contact of said plunger and said string, which render precision and consistency of pitch to the resulting tone.

4. A musical instrument in accordance with claim 1 wherein said sounding means comprises flexible plectrums operatively associated with said strings so as to cause said strings to vibrate by the plucking thereof; adjustable means operatively engaged with said plectrums which establish the depths at which said plectrums engage said strings; a leg-operated control connected with said adjustable means so that the movements of said leg-operated control are transferred to said adjustable means.

5. A musical instrument in accordance with claim 4 wherein said adjustable means comprises, associated with each string, an assembly, variable in proximity to said string, across which said plectrum tracks.

6. A musical instrument in accordance with claim 5 further characterized by said assemblies being physically joined.

7. A musical instrument in accordance with claim 4 wherein said connection includes a flexible cable core and outer casing, said outer casing being secured at both ends to stationary structures, and said cable core being secured at one end to said leg-operated control, and having its other end operatively engaged with said adjustable means.

8. A musical instrument in accordance with claim 4 wherein said connection includes electromagnetic means positioned in close proximity to said adjustable means, effecting magnetically the operation thereof; and a variable resistor operatively engaged with said leg-operated control, serving to regulate the current to said electromagnetic means.

9. A musical instrument in accordance with claim 4 wherein said leg-operated control is a foot pedal.

10. A musical instrument in accordance with claim 4 wherein said leg-operated control is a knee lever.

11. A musical instrument in accordance with claim 1 wherein said note selector means comprises, associated with each of said switching means, individual selector means the input condition of which is established by the status of said switching means, and the output condition electronically establishes the selected string and the vibrating length thereof; and, associated with each of said strings, ORing means which causes said sounding means to bring a string into vibration when said string is selected by any of said individual selector means.

12. A musical instrument in accordance with claim 11 further comprising electronic means which inhibits any of said individual selector means from selecting a string which has already been selected by another of said individual selector means.

13. A musical instrument in accordance with claim 12 wherein said individual selector means comprises electronic gates so configured as to establish electronically a priority for each output condition, whereby upon depression of the related key said individual selector means will select the string which is not in use, having the highest priority.

14. A musical instrument in accordance with claim 12 wherein said individual selector means comprises electronic gates so configured as to adopt one of a plurality of priority sets by which each output condition is assigned a priority, whereby upon depression of the related key said individual selector means will select the string which is not in use, having the highest priority.

15. A musical instrument in accordance with claim 11 wherein said circuit means further comprises "error" correcting means which senses a situation in which any one of said individual selector means, being activated, does not have a string available to it, and thereupon causes some of said individual selector means which have already selected a string to reselect, whereby a string can become available to said individual selector means with no string available to it.

16. A musical instrument in accordance with claim 15 wherein said sensing is accomplished by a digital magnitude comparitor comparing the number of keys depressed with the number of strings selected.

17. A musical instrument in accordance with claim 1 further comprises dampening means positioned in close proximity to each of said strings and being operatively connected to said circuit means so as to bring into physical contact with a string, soft matter to dampen said string whenever the key responsible for the sounding of said string is released.

18. A musical instrument in accordance with claim 17 further comprising leg activated means operatively connected with said circuit means which, when activated, electrically inhibits the operation of said dampening means and maintains current to said means for changing the vibrating lengths of said strings, thereby producing an effect analogous to that produced by the sustain pedal of a piano.

19. A musical instrument in accordance with claim 18 wherein said leg activated means comprises a foot pedal operatively engaged with an electrical switch.

20. A musical instrument in accordance with claim 18 wherein said leg activated means comprises a knee lever operatively engaged with an electrical switch.

21. A musical instrument in accordance with claim 1 further comprising transducer means associated with said strings serving to convert the sound thereof into electrical audio signals, whereby the sound of said strings may be electrically amplified.

22. A musical instrument in accordance with claim 21 further comprising audio signal dampening means operatively connected with said circuit means so as to negate said audio signals of any string whenever the key responsible for the sounding of said string is released.

23. A musical instrument in accordance with claim 22 further comprising leg activated means operatively connected with said circuit means which when activated, electrically inhibits the operation of said audio signal dampening means and maintains actuated said means for changing the vibrating lengths of said strings, thereby producing an effect analogous to that produced by the sustain pedal of a piano.

24. A musical instrument in accordance with claim 23 wherein said leg activated means comprises a foot pedal operatively engaged with an electrical switch.

25. A musical instrument in accordance with claim 23 wherein said leg activated means comprises a knee lever operatively engaged with an electrical switch.

26. A musical instrument in accordance with claim 1 further comprising means whereby the tensions of said strings can be altered, then returned to their initial states, effecting in any note being sounded a brief deviation from normal pitch.

27. A musical instrument in accordance with claim 26 wherein said tension altering means comprises a rod rotatable along its longitudinal axis, including diametric eyelets through which the ends of said strings are passed, then doubled back, partially circumvoluting said rod, whereby the tensions of said strings may be varied by the rotating of said rod; a leg-operated control; connecting means between said rod and said leg-operated control serving to transfer the movements of leg-operated control to said rod.

28. A musical instrument in accordance with claim 27 further comprising a spring connecting said rod with a stationary point so as to create a neutral position for said rod.

29. A musical instrument in accordance with claim 27 wherein said connecting means includes a flexible cable core and outer casing, said outer casing being secured at both ends to stationary structures, and said cable core being secured at one end to said leg-operated control, and at the other end to an appendage of said rod.

30. A musical instrument in accordance with claim 27 wherein said connecting means includes a variable resistor operatively engaged with said leg-operated control, serving to regulate current to electromagnetic means positioned so as to bring about rotation of said rod by the magnetic attraction to an appendage thereof.

31. A musical instrument in accordance with claim 27 wherein said leg-operated control is a foot pedal.

32. A musical instrument in accordance with claim 27 wherein said leg-operated control is a knee lever.

33. A musical instrument in accordance with claim 1 wherein said sounding means comprises flexible plectrums operatively associated with said strings so as to cause said strings to vibrate by the plucking thereof; adjustable means operatively engaged with said plectrums which establish the depths at which said plectrums engage said strings; detector means located under each key which generates a detection signal during the time in which said key is being depressed; electronic means, operatively connected with said detector means, which translates said detection signal into an electrical current proportional to the downward velocity of said key; electromagnetic means operatively associated with said adjustable means so as to magnetically adjust the positions thereof in response to said electrical current, whereby a plectrum will pluck its associated string with an intensity proportional to the downward velocity of the associated key.

34. A musical instrument in accordance with claim 33 wherein said adjustable means comprises, associated with each string, an assembly, variable in proximity to said string, across which said plectrum tracks.

35. A musical instrument in accordance with claim 33 wherein said detector means comprises single-pole-double-throw, break-before-make switches.

36. A musical instrument in accordance with claim 7 wherein said electronic means comprises, associated with each single-pole-double-throw, break-before-make switch, gating means and counting means configured so as to accumulate pulses produced by an oscillator or clock during the time that the center contact of said single-pole-double-throw, break-before-make switch is descending; and electrically connected with each of said electromagnetic means, a digital-to-analog converter and subsequent amplifier or driver which when supplied with the accumulation of said counting means produces a current proportional thereto; and distribution means which, in response to the selection of said circuit means, conveys the accumulation of said counting means to the appropriate digital-to-analog converter.

37. A musical instrument comprising, in combination, a keyboard including a plurality of keys, wherein associated with each key is switching means for electrical current; an equal plurality of taut strings of guitar gauge, wherein associated with each string are two confronting solenoids secured outwardly from the lower region of said string, having a common plunger with which a flexible plectrum is operatively engaged, whereby upon energization of one of said confronting solenoids said plectrum traverses said string in one direction, and upon energization of the other confronting solenoid said plectrum traverses said string in the opposite direction; electronic circuit means electrically located between said switching means and said solenoids, serving to regulate and drive said solenoids in response to electrical signals from said switching means, whereby said strings are plucked when their associated keys are depressed.

38. A musical instrument in accordance with claim 37 wherein said electronic circuit means includes amplification means associated with each of said solenoids, which upon receiving an electrical command to pluck provides said solenoids with an electrical current sufficient for operation; and toggle means serving to distribute alternately to said amplification means said electrical commands to pluck.

* * * * *